United States Patent [19]

Moltrasio

[11] 4,141,392

[45] Feb. 27, 1979

[54] APPARATUS FOR AUTOMATIC INSERTION OF VALVED BAGS ON BAG-FILLING MACHINES

[75] Inventor: Mario Moltrasio, Bergamo, Italy

[73] Assignee: Ventomatic Italiana S.r.l., Bergamo, Italy

[21] Appl. No.: 786,504

[22] Filed: Apr. 11, 1977

[30] Foreign Application Priority Data

May 6, 1976 [IT] Italy ..... 23018 A/76

[51] Int. Cl.[2] ..... B65B 1/00; B07C 9/00

[52] U.S. Cl. ..... 141/98; 141/68; 141/168; 209/601

[58] Field of Search ..... 73/52; 116/125; 141/10, 141/67, 68, 83, 94, 98, 114, 154, 165, 166, 168, 196, 270, 313–317, 392; 209/73

[56] References Cited

U.S. PATENT DOCUMENTS

| | | | |
|---|---|---|---|
| 3,464,547 | 9/1969 | Becker | 209/73 |
| 3,884,278 | 5/1975 | Nakashima | 141/114 X |

*Primary Examiner*—Richard E. Aegerter
*Assistant Examiner*—Frederick R. Schmidt
*Attorney, Agent, or Firm*—Parmelee, Johnson, Bollinger & Bramblett

[57] ABSTRACT

An apparatus for automatic insertion of a valved bag of paper or other flexible sheet material on to a charging nozzle of a machine adapted to fill the bag with material in granular or powder form, in which the bags are fed from a supply thereof sequentially by means of a distributing device to an inserting device. The inserting device includes means for picking up a bag from the distributing device, means for opening the valve and for testing the operativeness of the valve, means for discarding a bag with an inoperative valve and means for feeding a bag with an operative valve to the charging nozzle of the bag-filling machine.

11 Claims, 12 Drawing Figures

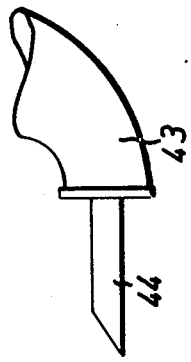
FIG. 6
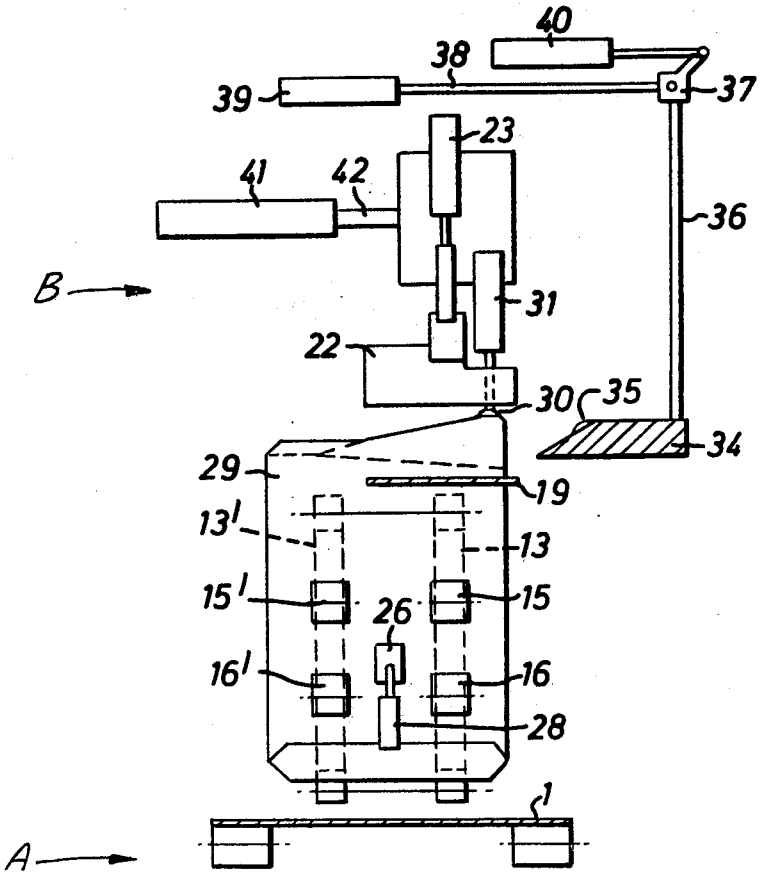

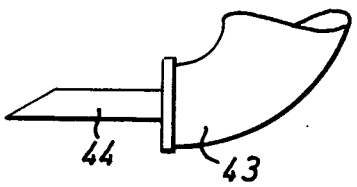
FIG. 7
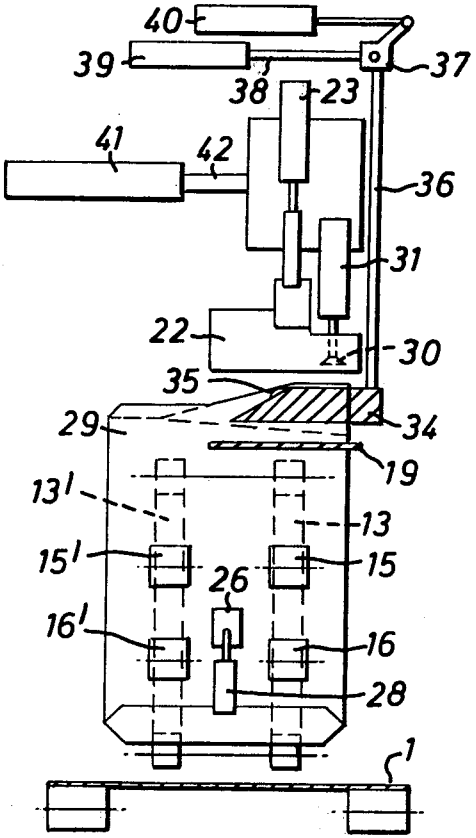

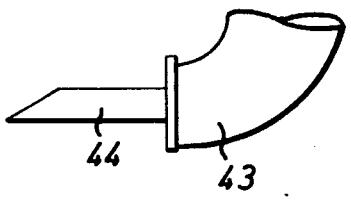
FIG.10
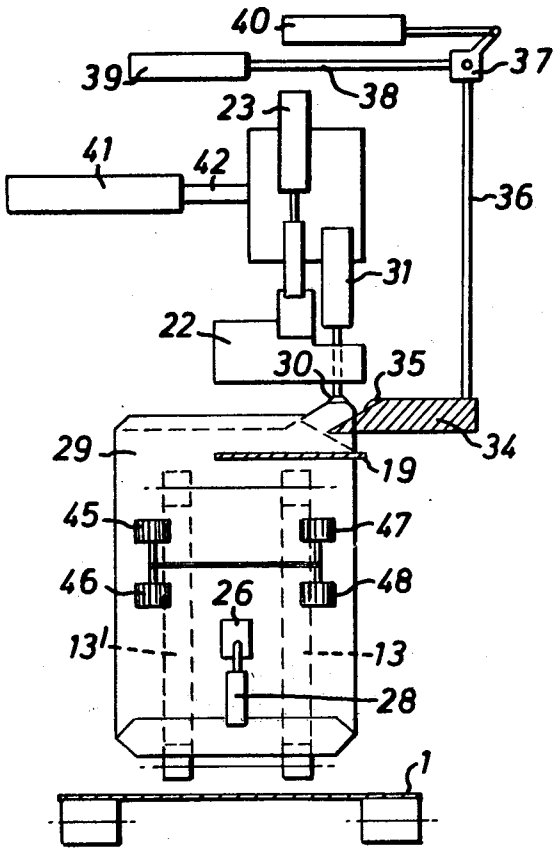

APPARATUS FOR AUTOMATIC INSERTION OF VALVED BAGS ON BAG-FILLING MACHINES

This invention relates to an apparatus for the automatic insertion of valved bags (as hereinafter defined) on machines for filling such sacks with materials in a granular or powder form.

BACKGROUND OF THE INVENTION

It is known that materials or goods in granular or powder form are marketed in substantially parallelepiped-shaped bags, which are manufactured in this shape and provided at either piece of one of the shorter sides of the top end of the bag with an opening having closing lips and constituting a valve, adapted to receive the charging nozzle of a sack-filling machine, said opening closing automatically as a result of the thrust exerted by the material within the bag upon the valve inner lip when said material has filled up the bag. Such bags will hereinafter be referred to as "valved bags".

Known bag-filling machines effect in a completely automatic cycle both the filling of the bag through the inserted charging nozzle and the removal of the bag after filling.

However, the attendance of an operator is required to pick up empty bags from a stack thereof and place them one at a time over the charging nozzle, meanwhile discarding any defective bags.

The valved bags are in fact, also manufactured on completely automatic machines which cut a web of paper or other sheet material of which the bag is to be manufactured, and fold it suitably in order to form the valve at one end, whereafter the edges are glued leaving the valve free.

These being high-production machines, minor defects are inevitable during the various stages of bag manufacture, particularly during the glueing stage and therefore it is common to find defective bags, mainly in the zone of the valve, which could appear glued or be difficult to open or have permanent wrinkles, and therefore during the working stage, effected at a predetermined rate, the bags must be discarded. Such a labour cost for an apparently simple operation raised the problem of mechanising the operation of lifting the bags for insertion on to the charging nozzle.

Recently devices have become known in the art which pick up one bag at a time from a stack or roll, open out the valve lips and thereafter push the bag on to the charging nozzle of a bag-filling machine, withdrawing thereafter to repeat the cycle.

Besides the fact that said devices are extremely complicated, none of them can discard the defective or inoperative bags, as the operator does, so that when they handle a bag having one of the above-mentioned defects (glued or badly manufactured valve, or wrinkles, which are rather usual events as it is well known to persons skilled in the art) they nonetheless carry out the operation causing the bag-filling machine to jam or even to break down, spreading the material all over and requiring therefore the operator's attendance to discard the defective bag and resume the operative cycle.

It is an object of the invention to provide an apparatus for automatic insertion of a valved bag, which besides collecting the bags from the pile or whatsoever packaging arrangement of the same and inserting the valve on the charging nozzle, checks the bag efficiency and in case of a defective bag discards it automatically without any external intervention.

SUMMARY OF THE INVENTION

Accordingly, the present invention consists in an apparatus for automatic insertion of a valved bag (as herein defined) on to a charging nozzle of a machine adapted to fill the bag with material in granular or powder form, comprising a distributing device receiving bags with their valves closed from a supply thereof and feeding them sequentially to at least one bag inserting device, the or each inserting device including means for picking up a bag from the distributing device, means for arranging the bag top end at valve side in a horizontal position and for opening the valve, means for testing the operativeness of the valve, means for discarding a bag with an inoperative valve, and means for placing a bag with an operative valve in a position in which the valve is adapted to engage the charging nozzle.

BRIEF DESCRIPTION OF DRAWINGS

In order that the invention may be more readily understood, reference is made to the accompanying drawings which illustrate diagrammatically and by way of example one embodiment thereof, and in which:

FIG. 6 is a side elevation of the apparatus of FIG. 1 and showing the means for testing the operativeness of the bag valve and the means for transferring the bag to the bag-filling machine, FIG. 7 is a view similar to that of FIG. 6 showing the valve testing means during operation thereof, FIGS. 10 and 11 show the apparatus in side elevation respectively during testing of an inoperative bag valve and during discarding of the bag with an inoperative valve.

Figure 1:
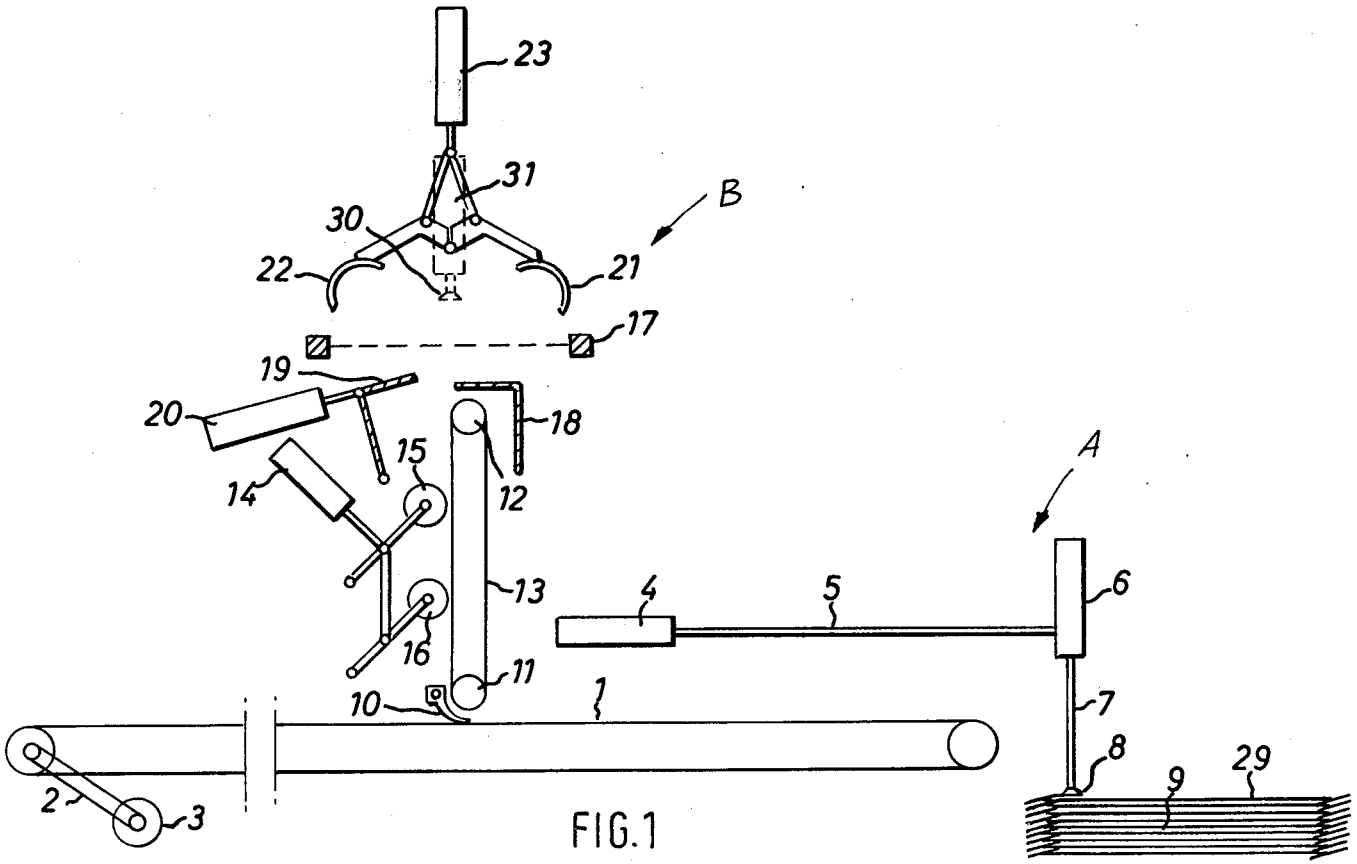
FIG. 1 is a front elevation of the apparatus in accordance with the invention, and showing the bag distributing device with some parts of a bag inserting device, at the start of the bag feeding operation.

Those parts governing the movements of the different members (valves, pipes, motors) have been neither described nor indicated in the drawings, as well as the circuits and devices (relays, micro-switches, etc.) controlling in sequence the different movements to be performed by said members of the apparatus, being a matter of simple design of electromechanical members applied to the working cycle of the apparatus of the present invention.

DETAILED DESCRIPTION OF DRAWINGS

Referring to the drawings, the apparatus according to the present invention essentially comprises a bag delivering and distribution means A (FIGS. 1 and 6) hereinafter referred to as "distributing device", and one or more devices B (FIGS. 1 and 6) of identical construction and operation for bag valve opening, valve testing and bag insertion, hereinafter referred to as "inserting device".

The bag distributing device A comprises a conveyor belt 1 arranged horizontally beneath the or each bag inserting device B and driven by belt means 2 from a motor 3. In the embodiment illustrated, only one bag inserting device B is shown, but it is to be understood that a plurality of such devices may be arranged in juxtaposed relationship longitudinally of the conveyor belt 1 which in such a case will have an appropriate length to service all the inserting devices present. The bag distributing device A includes a delivering means 4 to 8 which delivers individual valved bags 29 (as herein defined) from a stack 9 of folded bags to the conveyor belt 1 which feeds them sequentially with the valve closed to the or each inserting device. The delivering means is constituted by a first pneumatically or hydraulically operated piston and cylinder unit 4 which is arranged horizontally and the piston of which is connected to one end of a piston rod 5 which at its other end carries a second piston and cylinder unit 6 which is arranged vertically and the piston of which is connected to one end of a piston rod 7 which at its other end carries a pick up sucker 8 which is subjected in known manner to the action of vacuum.

The bag delivering means illustrated here diagrammatically, is provided with valves, fluid feeding and discharging pipes and other known control means (not shown), which cause the sucker 8, in the extended position of the pistons (FIG. 1), to engage a bag 29 on top of the stack 9, and when the pistons are retracted (FIG. 2) to lift and deliver the bag with its valved end leading on to the upper run of the conveyor belt 1. Upon interruption of the vacuum at the sucker 8, the conveyor belt 1 conveys the bag 29 towards the first unoccupied inserting device B where the bag on reaching a pivotably mounted deflecting member 10 of said device is deflected from the horizontal position on the conveyer belt 1 into a vertical position in said first inserting device. In the event that the first inserting device is already occupied (FIG. 3) by a previously delivered bag, the next following bag passes under the upwardly pivoted deflecting member 10 and is conveyed to the next unoccupied inserting device where the deflecting operation is repeated in the manner described above. The described bag delivering means for stacked bags may be replaced by other known devices should the bags be supplied from a roll or in any other form rather than from a stack.

The bag inserting device B comprises an assembly of mechanical units each performing an assigned operation hereinbelow explained in sequence.

Figure 2:
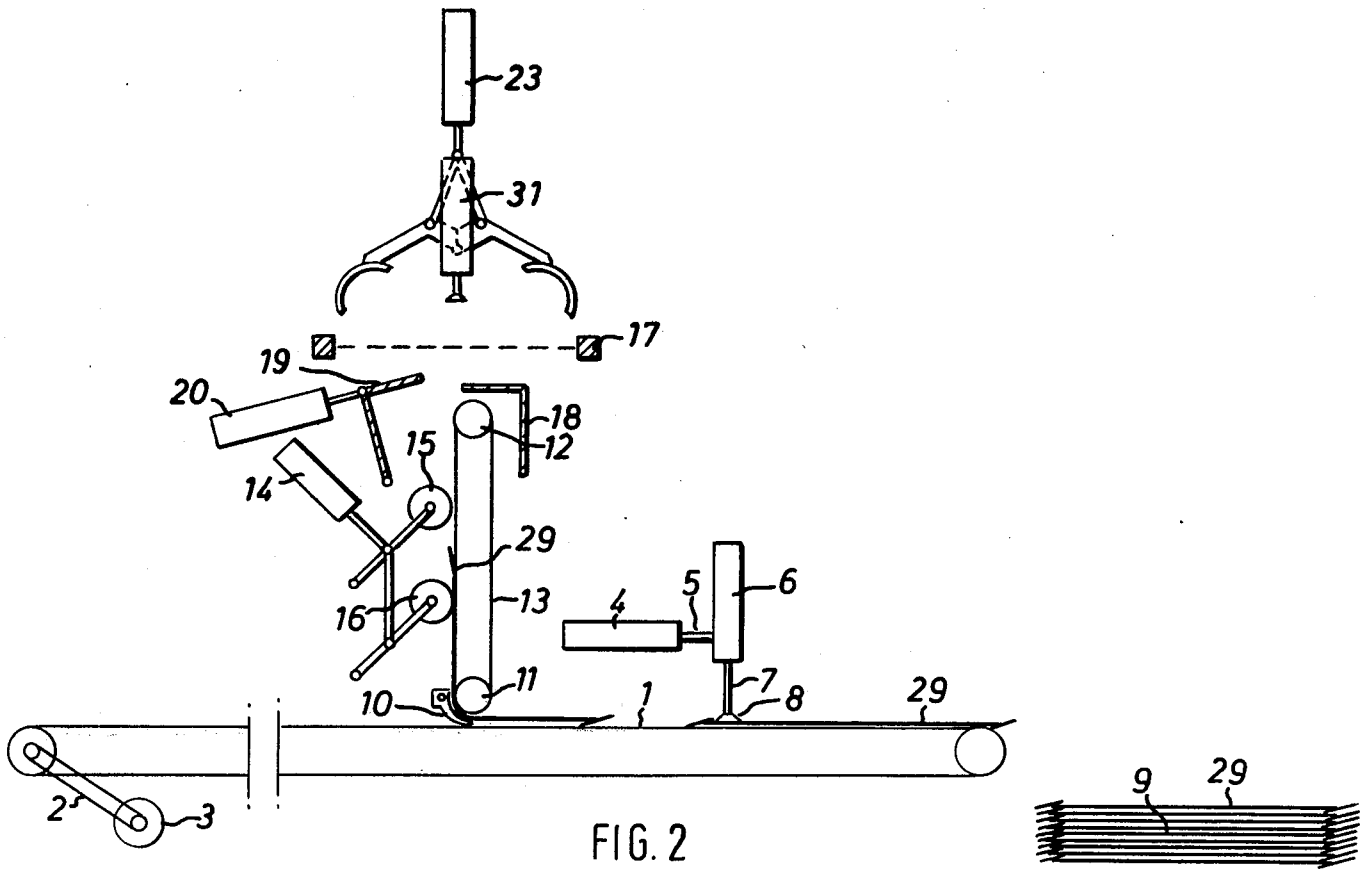
FIG. 2 shows the apparatus during the bag feeding operation and pick up from the distributing device.
Figure 3:
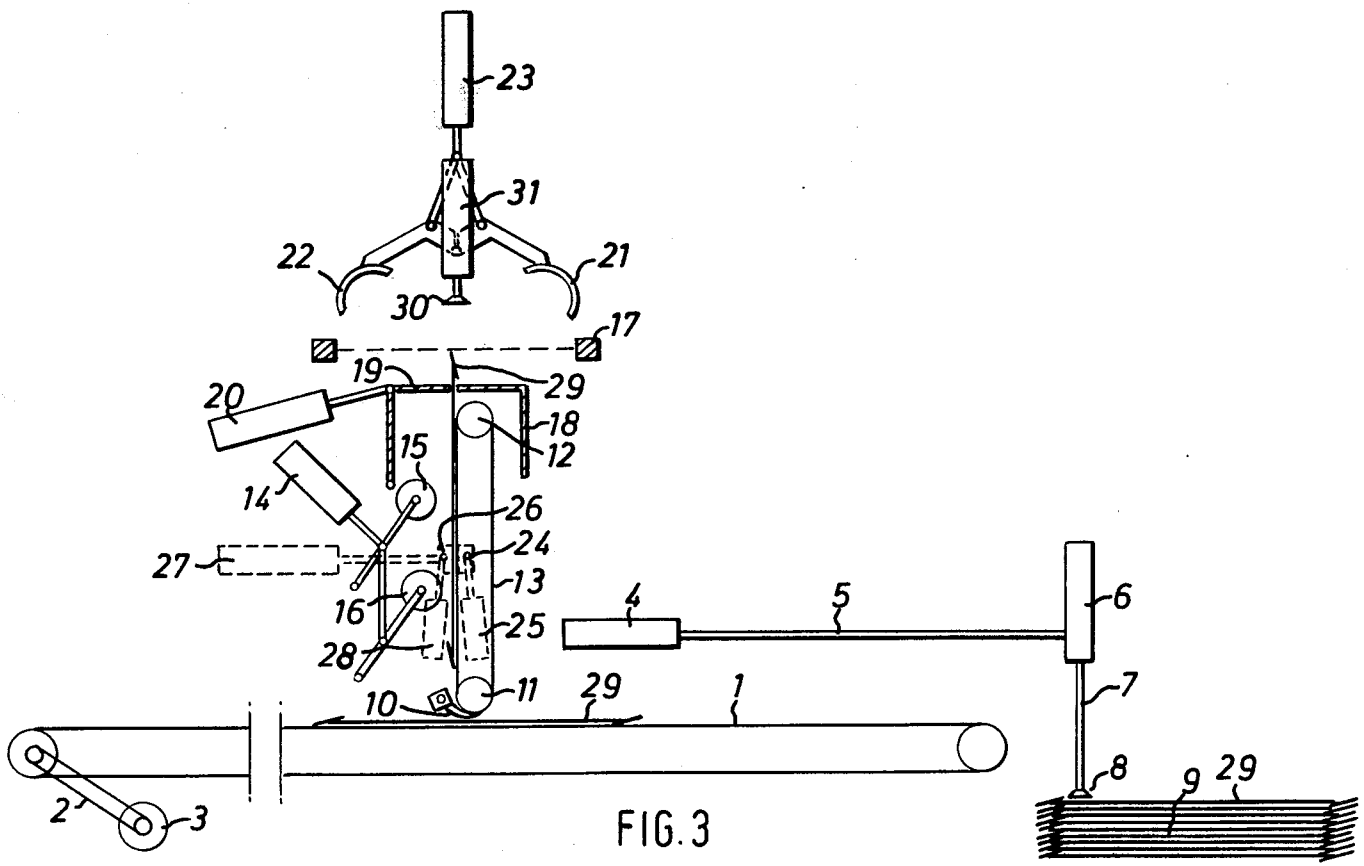
FIG. 3 shows the apparatus at the start of the bag valve opening operation with feeding of a following bag to a further bag inserting device.
Figure 4:
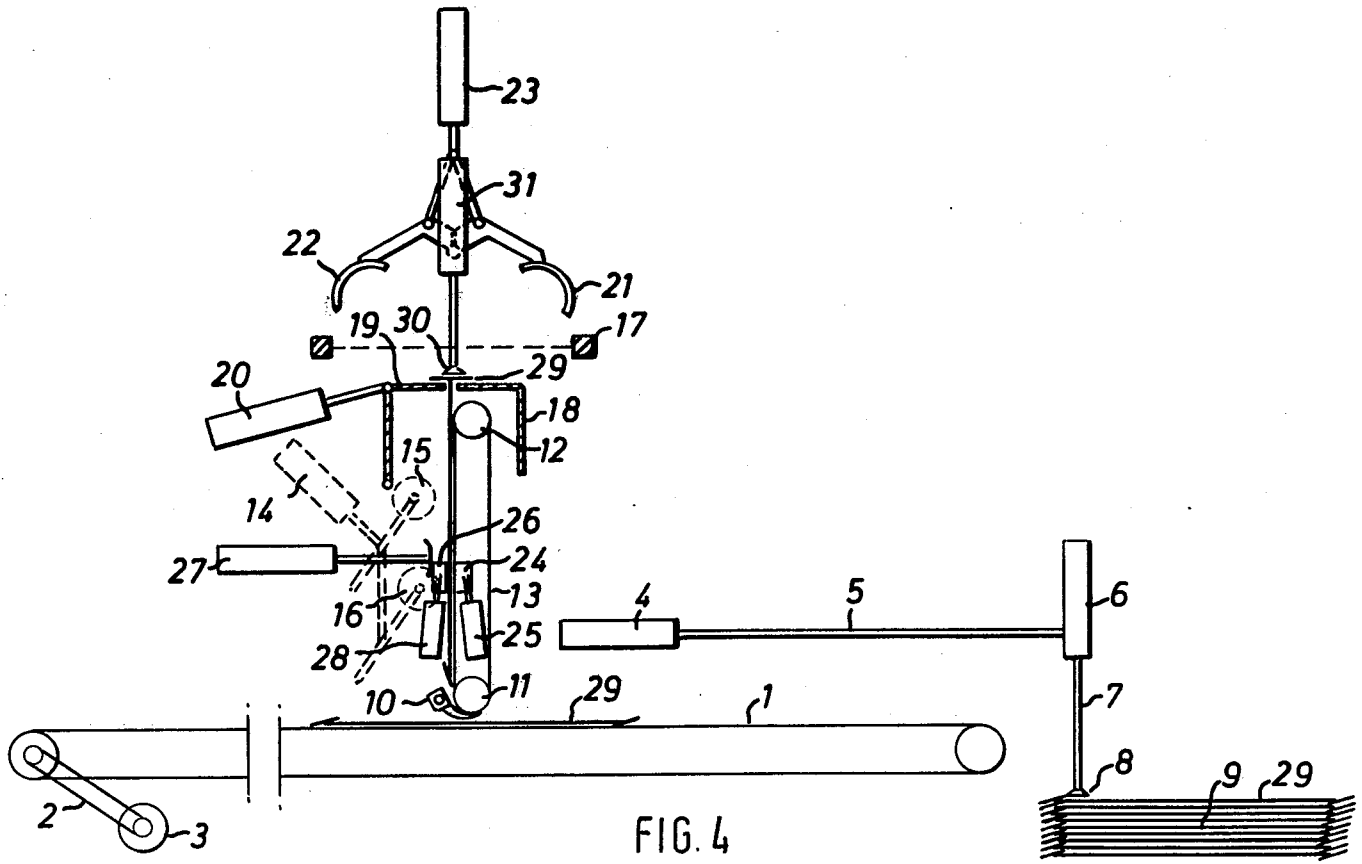
FIG. 4 shows the apparatus during a subsequent working step of the bag inserting device.

A bag pick up unit (see FIGS. 2 and 3) is substantially constituted by the deflecting member 10 which selectively can take up the two positions of FIGS. 1 and 3, by a vertically arranged belt conveyer comprising two continuously rotating motor-driven shafts 11 and 12 which drive two endless belts 13 and 13' (FIG. 6), and by pressure members comprising rolls 15, 15' and 16, 16' mounted on two articulated arms which actuated by a fluid-operated cylinder 14 can cause the rolls to be pressed against the belts 13, 13' or to be moved away therefrom. Thus, by means of the members forming the pick up unit, the bag carried on the conveyer belt 1 is first deflected through 90° by the member 10, then engaged between the two belts 13, 13' and the rolls 15, 15' and 16, 16' and carried upwards until the bag top end, provided with the valve, passes a stop device 17, for example a photoelectric cell, a microswitch or like control means.

A unit serving to arrange the bag top end (valved end) in a horizontal position and partially to open the valve (FIGS. 2, 3, 4 and 5) comprises a bag holding means 18, 19, a bag pulling means 24, 26 and a sucker 30 subjected to vacuum by known means. The bag holding means is constituted by a stationary jaw 18 and a movable jaw 19 which is actuated by a piston and cylinder unit 20 and which is adapted selectively to take up the positions of FIGS. 2 and 3. The bag pulling means includes a jaw 24, which is movable up and down by a piston and cylinder unit 25, and a further jaw 26 which is adapted to cooperate with the jaw 24 by effecting a horizontal closing movement on to the jaw 24 by the actuation of a piston and cylinder unit 27. The jaw 26 is further actuatable up and down in synchronism with the jaw 24 by a piston and cylinder unit 28 and is movable away from the jaw 24 by the piston and cylinder unit 27. The sucker 30 is actuatable by a piston and cylinder unit 31 for downward and upward movement.

Figure 5:
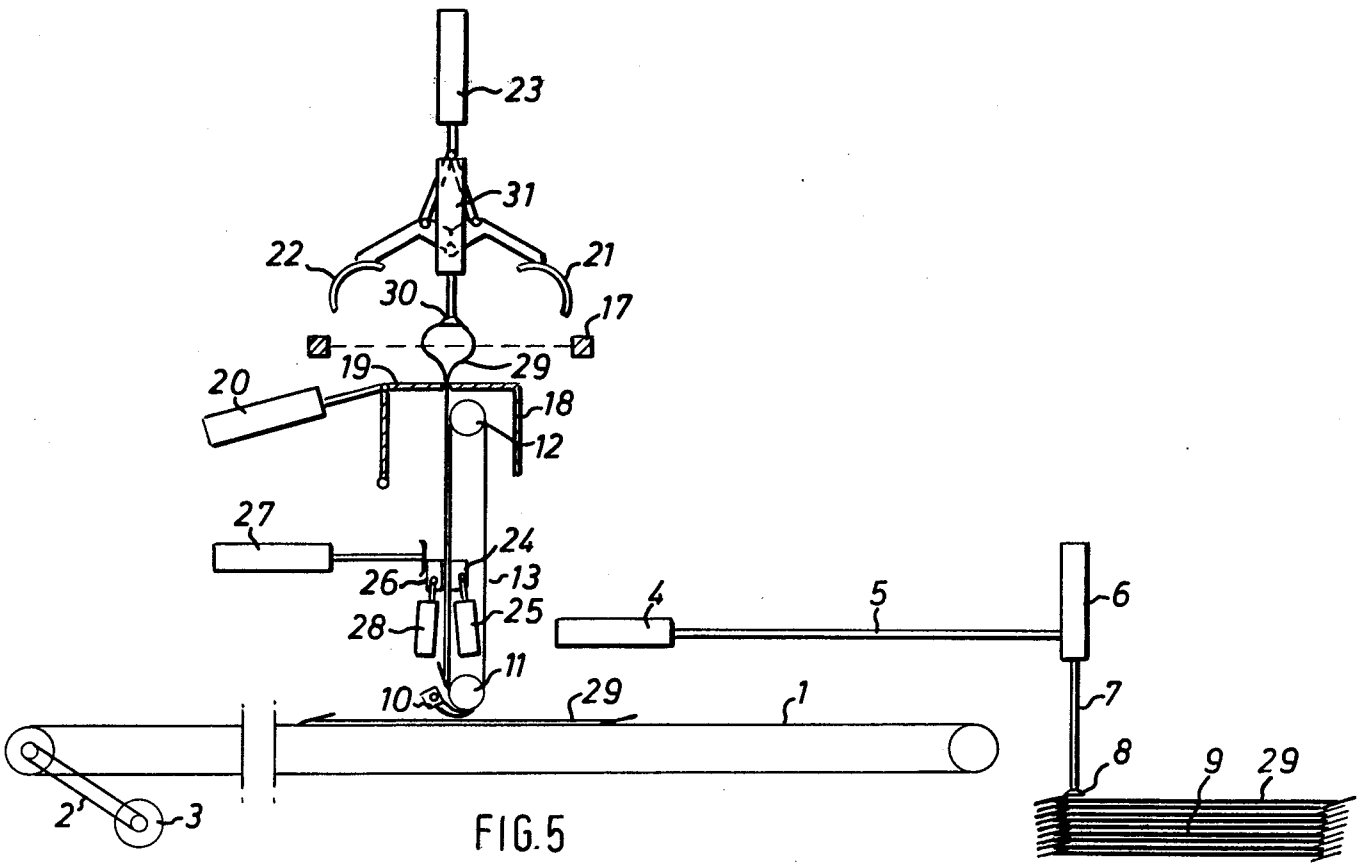
FIG. 5 shows the apparatus during the last stage of the bag valve opening operation.

It will be understood that when the bag top end first passes the stop device 17, the latter through the actuation of known driving means causes the various described means to effect a series of movements, i.e. the upward pivoting of the deflection member 10 to its position shown in FIG. 3, so that the next bag carried on the conveyor belt 1 passes beneath the pivoted deflection member 10 until the next bag is engaged by the deflection member of another inserting device; disengagement of the rolls 15, 15' and 16, 16' from the belts 13, 13'; closing of the movable jaw 19 against the stationary jaw 18 to hold the bag released by the rolls 15, 15' and 16, 16' in such a manner as to allow the bag, if subjected to a vertical pulling or pushing to slide between the jaws 18, 19; closing of the jaw 26 against the jaw 24 in such a manner as to hold the bag firmly; pulling downward of the bag following the actuation in such direction of the piston and cylinder units 25 and 28 in order that the top end of the bag comes to lie horizontally (FIG. 4); subsequently lowering of the sucker 30 to contact the bag top end at the valve upper lip; subjecting the sucker to vacuum and lifting it so as to pull the upper lip of the bag valve as shown in FIG. 5 whereby to cause the partial valve opening.

A unit for effecting the complete opening of the bag valve, the testing of the operativeness of the valve and for effecting the placing of a bag with an operative valve in a position in which the valve is adapted to engage the charging nozzle of a bag filling machine is shown in FIGS. 6, 7, 8 and 9. This unit comprises a sensing device 34 having the shape and dimensions similar to those of the charging nozzle. The sensing device 34 is provided with a sensor 35 of known construction and is carried on an arm 36 connected to a pivotable link 37 so as to assume the two positions of FIGS. 6 and 9 by virtue of actuation of the link 37 by a piston and cylinder unit 40, and once lowered as in FIG. 6 to be moved horizontally from the position of FIG. 6 to the position of FIG. 7 by the action of the retracted piston rod 38 of a piston and cylinder unit 39 on the link 37. The present unit also includes a piston and cylinder unit 41 of which the piston rod 42 is movable horizontally and at its free end carries an assembly of parts including the sucker 30 and its piston and cylinder unit 31 and two coacting curved jaws 21, 22 which serve to engage the top end of the bag 29 (FIG. 8) and which in this position define internally a shape substantially corresponding to the outer contour of the opened valve. The jaws 21, 22 are actuatable via respective arms pivotally connected to a piston and cylinder unit 23 to assume the two positions of FIGS. 4 and 8.

Figure 8:
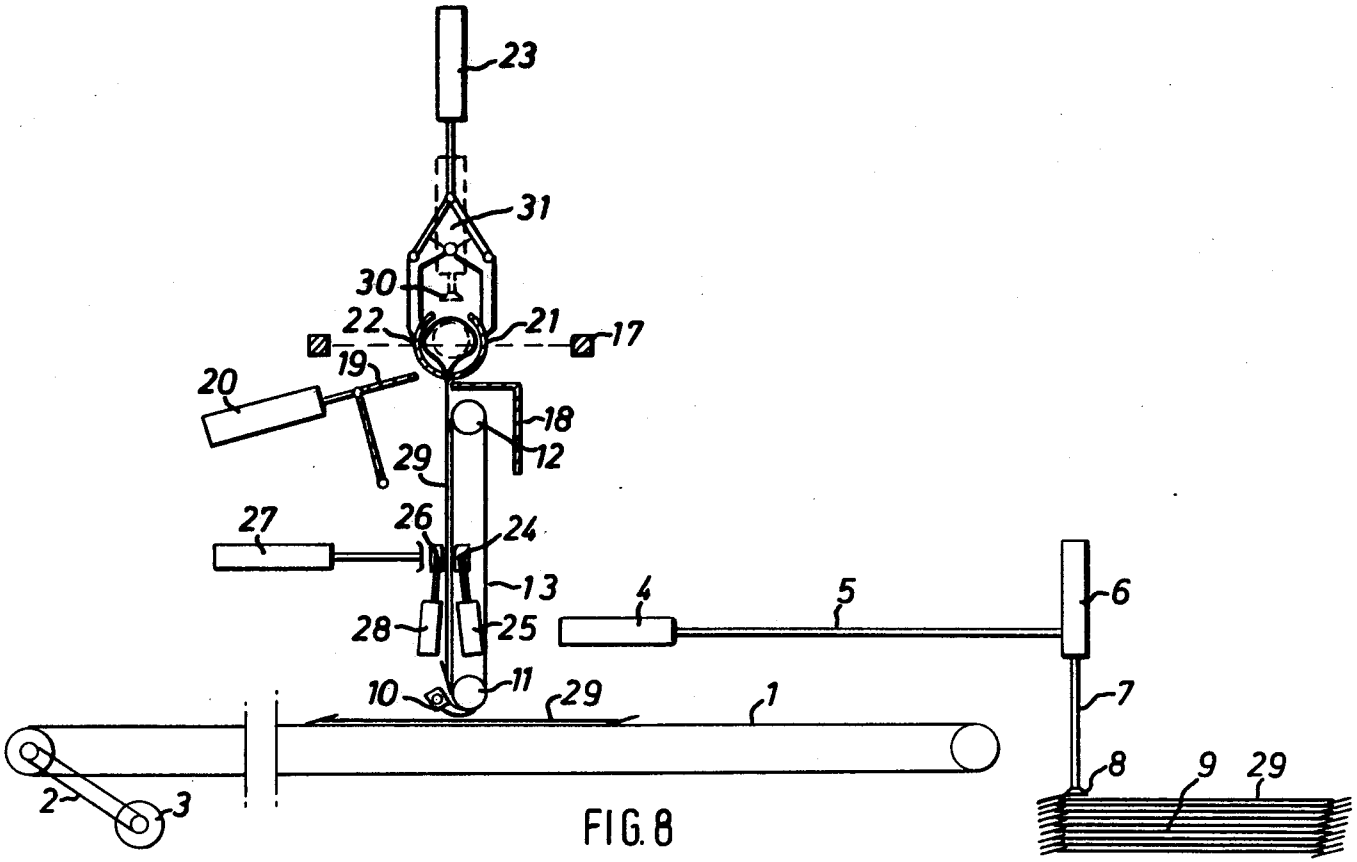
FIG. 8 shows the apparatus in front elevation prior to transfer of the bag to the bag-filling machine.
Figure 9:
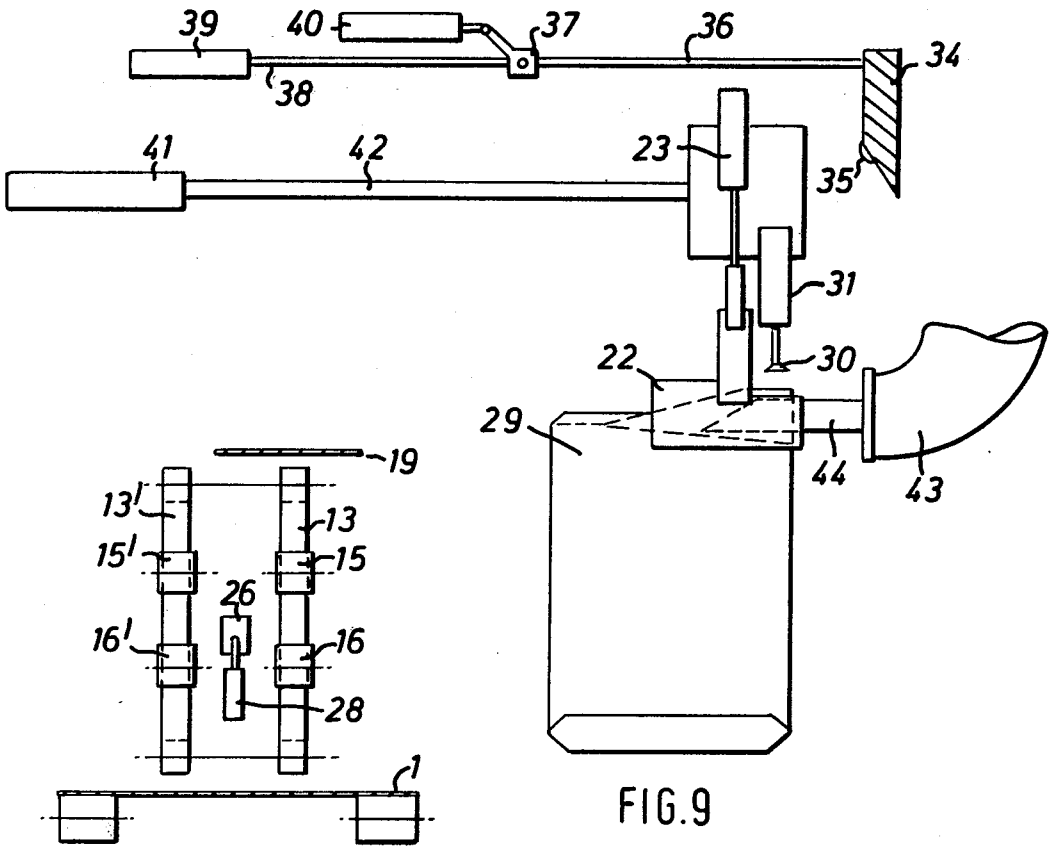
FIG. 9 shows the relevant parts of the apparatus in side elevation during the bag insertion on to a charging nozzle of the bag-filling machine.

Thus, subsequently to the initial partial valve opening as hereinbefore described, the following operations are effected: the sensing device 34, which during the previous operations was in the position of FIG. 9, is lowered into the position of FIG. 6 and by virtue of further retraction of the piston rod 38 enters the partially opened valve causing it to be opened completely until the sensor 35 encountering the valve upper lip allows the jaws 21, 22, which constitute a bag transfer means, to close as shown in FIG. 8 in such a manner as to engage and hold the bag by its top end, at the valve side and keeping the valve by virtue of its particular shape in an opened position. The sensing device 34 is now returned to its starting position (as seen in FIG. 9).

Next the bag transfer means are moved from the position of FIG. 8 towards the charging head 43 of a bag-filling machine, with which the apparatus of the present invention co-operates, until as shown in FIG. 9 the bag valve held by the two jaws 21, 22 engages the charging nozzle carried by the charging head of the bag-filling machine.

The inoperative bag discarding unit (FIGS. 10 to 12) comprises two pairs of fixedly mounted rollers 45, 46 and 47, 48 which are driven for rotation by a motor (not shown) and two further pairs of idle rollers 49, 50 and 51, 52 (FIG. 12) which are respectively mounted on arms 32 and 33 which are actuatable by a cylinder 53 so as to move its rollers towards and away from the rollers 45, 46 and 47, 48 and to engage the bag 29 located between the fixedly mounted and movable sets of rollers.

Figure 11:
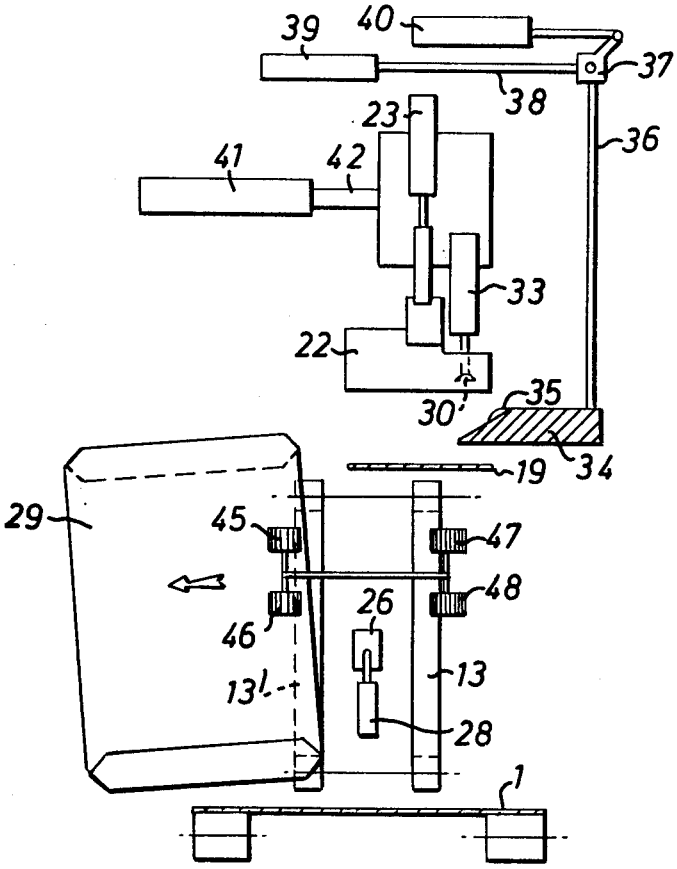
Figure 12:
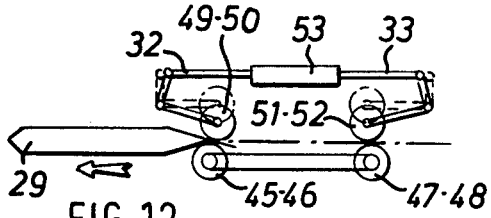
FIG. 12 is a plan view of the lower part of the apparatus in FIG. 11 during the bag discarding operation.

Thus, should the sensor 35 not completely enter the bag valve and therefore prevent the bag transfer to the bag filling machine, the cylinder 53 is operated (by known means) to cause the bag with the inoperative valve to be engaged between the two sets of rollers and by virtue of the continuous rotation of the rollers 45, 46 and 47, 48 to be moved laterally out of the inserting device in the direction of the arrow indicated in FIGS. 11 and 12 and to be discarded. At the end of this operation the inserting device is ready to receive the next bag.

The operation of the apparatus has already been partially explained in the course of the foregoing description.

Considering that the apparatus of the invention comprises a bag distributing device to service one or more bag inserting devices, usually of a number equal to the charging nozzles of a bag-filling machine, but being also possible that one inserting device serves more than one charging nozzle of the bag-filling machine, the operation of the apparatus is carried out as follows:

The pick-up unit of appropriate kind picks up one by one the bags 29 from the stack 9, placed close to the apparatus, with the valved end loading and deposits them on the conveyer belt 1 by means of the delivery sucker 8 in which vacuum is induced or interrupted depending whether the sucker 8 has to pick up the bag from the stack or deposit it on the conveyer belt 1 respectively (FIGS. 1 and 2).

The bag is carried on the conveyer belt passing under the inserting devices already working, i.e. occupied by a preceding bag (see FIG. 3), up to an unoccupied device, i.e. one having the deflecting member 10 grazing the surface of the upper run of the conveyer belt so as to engage the oncoming bag, deflect it through 90° and lift it along conveyer belts 13 and 13' for engagement and further vertical transport by the pressure exerted against said belts by the rolls 15, 15' and 16, 16' (FIG. 2).

When the bag top end passes the device 17, the latter causes (through appropriate means) upward pivoting, as shown in FIG. 3, of the deflecting member 10, closing of jaw 19, moving away of rolls 15, 15' and 16, 16' and engagement of the bag between the jaws 24 and 26 of the bag pulling means (FIG. 3). Immediately thereafter, the bag downward pulling occurs as a result of downward movement of the jaws 24 and 26 actuated by the cylinders 25 and 28, so that the bag top end with its valve is arranged horizontally. Next the sucker 30 is lowered on to the bag top end at the valved side (FIG. 4) and after engaging the valve upper lip by virtue of the vacuum induced in the sucker 30 returns to its previous upward position causing the partial opening of the valve mouth (FIG. 5). At this point the sensing device 34 is pivoted downward to the valve mouth (FIG. 6) and moved by the cylinder 39 towards and into the opened bag valve, thus completing the valve opening until the sensor 35 coming into contact with the bag upper lip and ascertaining the operativeness of the valve (FIG. 7) initiates the insertion operation which starts with the withdrawal of the sucker 30 to its rest position, and is followed by the closing of the jaws 21 and 22 of the bag holding means around the valve mouth (FIG. 8), still with the sensing device in operation, the sensor disengagement and return of the sensing device to its rest position (FIG. 9), and finally by the movement of the bag with its valve mouth enclosed by the jaws 21 and 22 towards the charging head of the bag-filling machine and the insertion of the bag valve on to the charging nozzle 44 on the charging head.

The bag top end holding means, after having left the bag at the charging nozzle following the opening of the jaws 21 and 22, returns to its initial position, the deflecting member 10 is pivoted downwardly to graze the conveyer belt and the inserting device is again ready to engage and receive the first arriving fresh bag.

In the event that a defective bag reaches the valve opening unit, so that after the above described operations the valve does not open or for whatever reason it is not properly arranged so that it is inoperative and therefore the sensing device cannot completely enter the valve, the discarding unit is actuated (FIGS. 10 to 12), following an appropriate control signal being sent to the cylinder 53, so that the defective bag is discarded and the inserting device is again made ready to receive a fresh bag.

In an alternative arrangement (not shown), the conveyer belt 1 may be replaced by an equivalent transport means and instead of the device picking up the bags from a stack, a device feeding the bags from a roll or any other supply arrangement, may be used.

The several inserting devices instead of being fixedly mounted could be movable along a straight (rectilinear) or circular (carousel) paths and each one working for a plurality of charging nozzles of a bag-filling machine. The first step of the valve opening effected in the present embodiment by the sucker, may be effected by other means, for example inclination to the opposite direction of the bag bottom or lateral pressure on the valve sides.

I claim:

1. An apparatus for automatic insertion of a valved bag on a charging nozzle of a machine adapted to fill the bag with material in granular or powder form, comprising a distributing device and at least one bag inserting device, said distributing device for receiving bags with their valves closed from a supply thereof and for feeding them sequentially to at least one bag inserting device, said distributing device including conveying means extending horizontally beneath each such said inserting device, each such inserting device including a movable bag-deflecting member for picking up a bag from the distributing device and which is arranged in a grazing manner relative to the conveying means and which causes the bag to be deflected from a horizontal position on the conveying means into a vertical position, two juxtaposed running endless belts and at least one set of pressure rolls cooperating with each belt, said running belts and pressure rolls being positioned for receiving a deflected bag between them for entraining and conveying the bag therebetween upwardly valve-end first towards two bag-holding jaws arranged above said running belts and pressure rolls, means for engaging said jaws against opposite sides of the bag below the valve end of the bag, means for arranging the bag top end at the valve side in a horizontal position above said jaws and means for partially opening the valve, means for testing the operativeness of the partially opened valve, means for discarding a bag with an inoperative valve, and means for placing a bag with an operative valve in a position in which the valve is adapted to engage the charging nozzle.

2. An apparatus as claimed in claim 1, wherein said means for partially opening the valve includes pressure means provided above said holding jaws for exerting a lateral pressure on the outer edges of the valve.

3. An apparatus as claimed in claim 1, wherein the means for testing the operativeness of the valve is constituted by a sensing member having a shape and dimensions substantially corresponding to those of the charging nozzle of the bag-filling machine, said member being mounted on a movable arm, which for actuating said arm to carry said member in front of the partially opened valve and to push the member through the opening in the valve so as to open it completely, and said sensing member having a sensor thereon for sensing whether or not said sensing member has completely entered the valve unhindered and for controlling said bag placing means whereby only if the sensing member enters the valve unhindered, the sensor allows the bag to be moved by said bag placing means towards the charging nozzle of the bag-filling machine.

4. An apparatus as claimed in claim 3, wherein the operation of said discarding means is initiated by a signal from the sensor in the event of an obstruction to entry of said sensing member into the partially opened valve.

5. An apparatus as claimed in claim 1, wherein the means for discarding a bag with an inoperative valve is constituted by at least one pair of rolls arranged with their axes of rotation vertically beneath the said bagholding jaws, one roll of said pair being fixedly mounted and driven by a motor, the other roll being mounted on a fluid-operated cylinder which can move said other roll toward the fixed roll, and said fluid-operated cylinder being controlled by said testing means so that a bag located between said rolls is laterally discarded in a direction opposite to the insertion direction.

6. An apparatus as claimed in claim 1, wherein the means for placing a bag with an operative valve in a position for engagement with the charging nozzle is constituted by two co-acting curved jaws which are movable to enclose laterally the opened valve and drive means connected to said jaws for moving said jaws to enclose laterally the opened valve and for moving the bag horizontally towards the charging nozzle, said curved jaws being so shaped and dimensioned that the inner perimeter of the closed jaws is substantially equal to the outer perimeter of the opened valve.

7. An apparatus as claimed in claim 1, including actuating means connected to said pressure rolls for moving said rolls toward and away from the respective endless belt, said actuating means moving said pressure rolls away from the respective endless belt when the bag is engaged by the two holding jaws, one of said holding jaws being movably mounted and the other being stationary, said jaws, in the bag-engaging position, allowing the bag to slide vertically between the jaws when a downward force is applied to the bag.

8. An apparatus as claimed in claim 7, wherein two coacting further jaws are provided below said bag-holding jaws, further actuating means connected to said further jaws for causing said further jaws to move into gripping relationship with the bag and for applying such downward force to the bag for sliding the bag downwardly relative to said bag-holding jaws for positioning the valve end of the bag against said bag-holding jaws with the valve end of the bag at the top thereof and arranged in a horizontal position, movable sucker means positioned above said bag-holding jaws and being arranged to engage the top end of the bag near said valve and to pull upwardly on the top end of the bag for partially opening said valve.

9. An apparatus as claimed in claim 8, wherein said bag-holding jaws have base surfaces engageable with the opposite sides of the bag, said base surfaces of the bag-holding jaws having a V-shaped construction for aiding in the partial opening of the valve.

10. A machine for automatically inserting a valved bag made of flexible sheet material, such as paper, and having an openable valve located at one end of the bag onto a charging nozzle of a bag-filling machine for filling the bag with material in granular or powdered form comprising:

at least one bag-inserting apparatus for opening the valve of a valved bag, for testing the opened valve and for inserting the bag with its valve opened onto the charging nozzle of such a bag-filling machine;

distributing apparatus for receiving the valved bags from a supply thereof with their valves closed and for feeding them sequentially to at least one such bag-inserting apparatus;

said bag-inserting apparatus including bag picking up means for picking up a bag from said distributing apparatus and for feeding the bag in a first direction valved-end first, stop means for sensing the position of a bag being conveyed and for stopping said picking up means when the valved end of the bag has reached a predetermined position, a pair of opposed jaws operatively associated with said picking up means and being positioned on opposite sides of the bag when the bag is in said predetermined position, operating means connected to said jaws for relatively closing said jaws against opposite sides of the bag below its valved end, bag pulling means for pulling the bag back in the opposite direction for pulling the valved end of the bag against said jaws for arranging the valved end of the bag in a traverse position against said jaws, means for opening the valve, means for testing the operativeness of the opened valve, means for discarding a bag with an inoperative valve, and means for placing a bag with an operative valve in a position in which the valve is adapted to engage the charging nozzle.

11. An apparatus for automatic insertion of a valved bag on a charging nozzle of a machine adapted to fill the bag with material in granular or powder form comprising:

two juxtaposed running endless belts and at least one set of pressure rolls cooperating with each belt, a pair of bag-holding jaws arranged above said running belts and pressure rolls, said running belts and pressure rolls being positioned for receiving a valved bag between them for entraining and conveying the bag therebetween upwardly valve-end first towards said pair of bag-holding jaws, means for engaging said jaws against opposite sides of the bag below the valve end of the bag, means for arranging the top end of the bag at the valve side in a horizontal position above said engaged jaws and means for partially opening the valve, means for testing the operativeness of the partially opened valve, means for discarding a bag with an inoperative valve, and means for placing a bag with an operative valve in a position in which the valve is adapted to engage the charging nozzle.

* * * * *